US008191531B2

(12) United States Patent
Kang et al.

(10) Patent No.: US 8,191,531 B2
(45) Date of Patent: Jun. 5, 2012

(54) METHOD FOR CONTROLLING AN ENGINE VALVE OF AN INTERNAL COMBUSTION ENGINE

(75) Inventors: Jun-Mo Kang, Ann Arbor, MI (US); Hanho Yun, Oakland Township, MI (US); Chen-Fang Chang, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 325 days.

(21) Appl. No.: 12/693,588

(22) Filed: Jan. 26, 2010

(65) Prior Publication Data

US 2011/0184630 A1 Jul. 28, 2011

(51) Int. Cl.
*F02D 13/02* (2006.01)
*F02D 13/00* (2006.01)

(52) U.S. Cl. ..... 123/345; 123/90.12

(58) Field of Classification Search ..... 123/345, 123/346, 347, 348, 90.12, 90.15, 90.11; 701/105
See application file for complete search history.

(56) References Cited

U.S. PATENT DOCUMENTS

| | | | | |
|---|---|---|---|---|
| 4,696,265 | A * | 9/1987 | Nohira | 123/90.16 |
| 5,005,540 | A * | 4/1991 | Watanabe | 123/90.12 |
| 7,204,212 | B2 * | 4/2007 | Donaldson | 123/90.12 |
| 2010/0263611 | A1 * | 10/2010 | Kenchington et al. | 123/90.12 |

* cited by examiner

*Primary Examiner* — Mahmoud Gimie

(57) ABSTRACT

An internal combustion engine system is equipped with a controllable engine valve actuation system. Controlling lift of an engine valve includes periodically monitoring engine valve lift and engine crank angle. A preferred engine valve lift profile is determined in a crank angle-domain. A preferred engine valve position is determined in the crank angle-domain. The preferred engine valve position is interpolated to determine a preferred engine valve position in the time-domain. The control circuit is actuated to control the engine valve in the time-domain.

12 Claims, 8 Drawing Sheets

METHOD FOR CONTROLLING AN ENGINE VALVE OF AN INTERNAL COMBUSTION ENGINE

TECHNICAL FIELD

This disclosure is related to repetitive controllers used in internal combustion engines.

BACKGROUND

The statements in this section merely provide background information related to the present disclosure and may not constitute prior art.

Internal combustion engines can use camless variable valve actuation systems including fully flexible valve actuation (FFVA) systems. A valvetrain system including fully flexible valve actuation provides full-range control of engine valve open duration, engine valve open phasing relative to crankshaft rotation, and magnitude of engine valve lift from fully closed to fully open without depending upon the contours of a cam surface. Electrically or hydraulically controlled fully flexible valve actuation systems may enable valves to open multiple times during an engine cycle, or not at all, such as during cylinder deactivation events.

Internal combustion engine controls include time-domain based elements and crank angle-domain based elements related to engine dynamics. Time-domain based engine dynamics can be described using differential equations (linear or nonlinear), whereas the crank angle-based dynamics can be described using rates of change relative to crank angle. Therefore, crank angle based dynamics correspond to crank angle rotation and not time. When engine speed is constant, time-domain based engine dynamics synchronize with crank angle-domain based engine dynamics. Control modules and controllers perform control tasks in both fixed time intervals (i.e., time-based controls) and fixed crank-angle intervals (i.e., event-based controls) to jointly control and monitor various engine operations. For example, sensors and actuators used in engine applications are mostly time-domain based systems. However, engine flow and combustion interactions with the sensors and actuators are crank angle-based.

Control of variable valve actuation systems including fully flexible valve actuation systems entails opening and closing of intake and exhaust engine valves at predetermined profiles as a function of crank-angle preferably repeatable at 720-degree crank angle iterations. Due to this repetitive nature, a repetitive controller can be used to control the fully flexible valve actuation system with high precision. Furthermore, due to the time-based nature of its dynamics, control of the fully flexible valve actuation system is time-domain based. However, during powertrain operation it is preferable for valve actuation to coincide with particular crank angles, in order to synchronize with fuel injection, spark, and combustion timing. Therefore, conversion between control in the time-domain and the crank angle-domain is desirable. Valve actuation can become non-periodic with respect to time, e.g., when the engine speed fluctuates. Inexact conversion from a time-domain based control to a crank angle-domain based control can cause undesirable engine valve motion resulting in poor combustion. Therefore, it would be advantageous to compensate for the non-periodic disturbances in the valvetrain control system for repetitive tasks such as opening and closing of intake and exhaust engine valves at a constant profile as a function of crank-angle that repeats every 720-degree crank angles.

SUMMARY

A method for controlling an engine valve of an internal combustion engine includes periodically monitoring an engine valve lift and a corresponding engine crank angle, determining a preferred engine valve lift profile in a crank angle-domain, determining a preferred engine valve position in the crank angle-domain associated with the preferred engine valve lift profile, the monitored engine valve lift, and the engine crank angle. The preferred engine valve position in the crank angle-domain is interpolated to determine a preferred engine valve position in the time-domain. The method further includes actuating a control circuit configured to control a position of the engine valve to the preferred engine valve position in the time-domain.

BRIEF DESCRIPTION OF THE DRAWINGS

One or more embodiments will now be described, by way of example, with reference to the accompanying drawings, in which.

DETAILED DESCRIPTION

Figure 1:
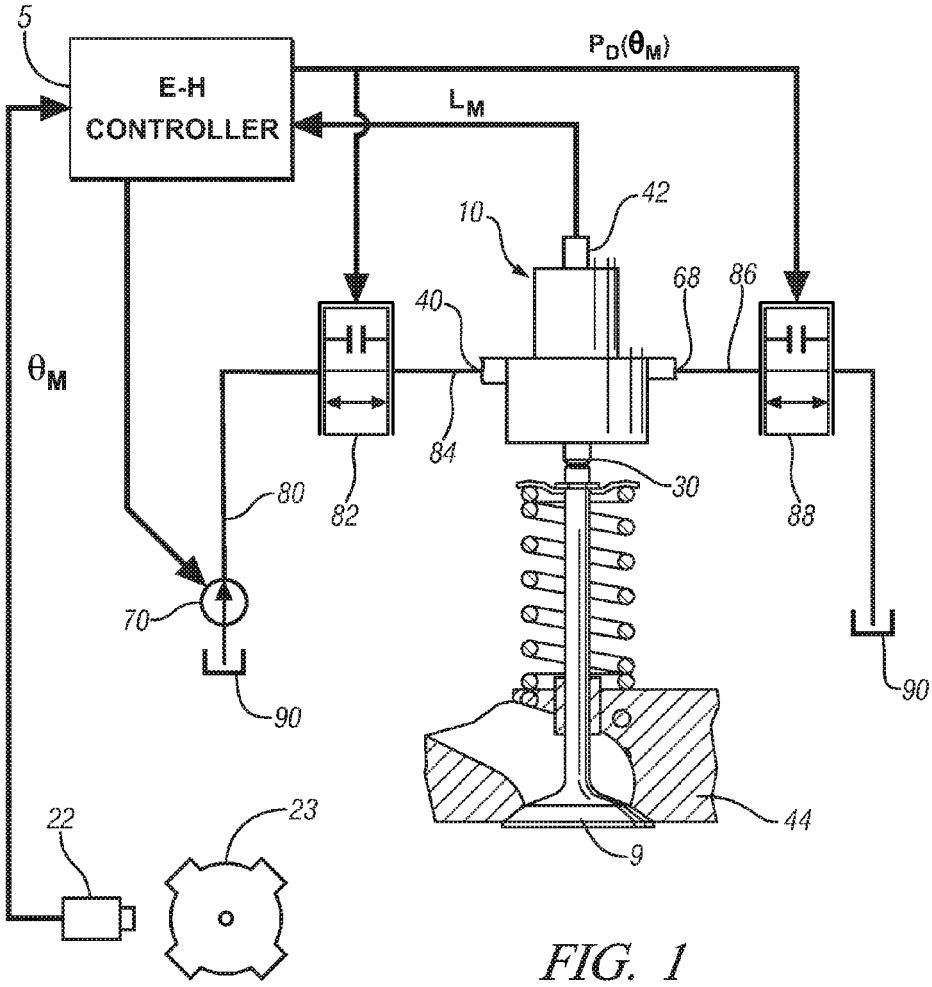
FIG. 1 is a schematic diagram of a control circuit for actuating a single engine valve of an internal combustion engine in accordance with the present disclosure.

Referring now to the drawings, wherein the showings are for the purpose of illustrating certain exemplary embodiments only and not for the purpose of limiting the same, FIG. 1 schematically shows an exemplary control circuit for actuating a single engine valve 9 of an internal combustion engine. The exemplary control circuit includes a fully flexible electro-hydraulic valve actuation system including an engine valve actuator 10 that can be implemented on a multi-cylinder internal combustion engine. The exemplary control circuit may be used to actuate an engine valve 9 including either one of an intake and an exhaust valve. It should be appreciated that the disclosure herein can be applied to various internal combustion engine systems and combustion modes including e.g., spark-ignition engines and compression-ignition engines, and combustion modes including homogeneous spark-ignition combustion, controlled auto-ignition combustion, stratified-charge spark-ignition combustion mode, compression-ignition, and premixed charge compression ignition. It should also be appreciated that the disclosure herein can be applied to various internal combustion engine systems operating a stoichiometric air/fuel ratio, a lean air/fuel ratio, and a rich air/fuel ratio.

The exemplary engine includes a multi-cylinder direct-injection four-stroke internal combustion engine having reciprocating pistons slidably movable in cylinders which define variable volume combustion chambers. Each piston is connected to a rotating crankshaft by which their linear reciprocating motion is translated to rotational motion. An air intake system provides intake air to an intake manifold which directs and distributes air into an intake runner to each combustion chamber. The air intake system includes airflow ductwork and devices for monitoring and controlling the air flow. The air intake devices preferably include a mass airflow sensor for monitoring mass airflow and intake air temperature. A throttle valve preferably includes an electronically controlled device which controls air flow to the engine in response to a control signal from an engine control module. A pressure sensor in the manifold is adapted to monitor manifold absolute pressure and barometric pressure. An external flow passage recirculates exhaust gases from engine exhaust to the intake manifold, having a flow control valve, referred to as an exhaust gas recirculation valve. The engine control module is operative to control mass flow of exhaust gas to the intake manifold by controlling opening of the exhaust gas recirculation valve.

A cylinder head 44 preferably includes a cast-metal device providing a mounting structure for the engine intake and exhaust valves including the engine valve 9 and associated engine valve actuator 10. At least one intake valve and one exhaust valve corresponds to each cylinder and combustion chamber. There is preferably one engine valve actuator 10 for each engine valve 9. Each intake valve can allow inflow of air and fuel to the corresponding combustion chamber when open. Each exhaust valve can allow flow of products of combustion out of the corresponding combustion chamber to an exhaust system when open.

The engine can include a fuel injection system, including a plurality of high-pressure fuel injectors each adapted to directly inject a mass of fuel into one of the combustion chambers, in response to a signal from the engine control module. The fuel injectors are supplied pressurized fuel from a fuel distribution system. The engine can include a spark-ignition system by which spark energy is provided to a spark plug for igniting or assisting in igniting cylinder charges in each of the combustion chambers in response to a signal from the engine control module.

The engine is equipped with various sensing devices for monitoring engine operation, including a crank sensor 22 having output $\theta_M$ corresponding to crankshaft rotational position of a crank wheel 23, i.e., crank angle, and can be used to monitor crankshaft rotational speed. An exhaust gas sensor monitors the exhaust gas feedstream, and can include an air/fuel ratio sensor in one embodiment.

The engine control module executes algorithmic code stored therein to control the aforementioned actuators to control engine operation, including throttle position, spark timing, fuel injection mass and timing, intake and/or exhaust valve timing and phasing, and exhaust gas recirculation valve position to control flow of recirculated exhaust gases. Valve timing and phasing may include a negative valve overlap period and use of multi-step valve lift in an exhaust re-breathing strategy. The engine control module is adapted to receive input signals from an operator (e.g., an accelerator pedal position and a brake pedal position) to determine an operator torque request and from the sensors indicating the engine speed and intake air temperature, and coolant temperature and other ambient conditions.

As used herein, control module, controller, module and similar terms may take any suitable form including various combinations of one or more Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs, combinational logic circuit(s), input/output circuit(s) and devices, appropriate signal conditioning and buffer circuitry, and other suitable components to provide the described functionality. The control module has a set of control algorithms, including resident software program instructions and calibrations stored in memory and executed to provide the desired functions. The algorithms are preferably executed during preset loop cycles. Algorithms are executed, such as by a central processing unit, and are operable to monitor inputs from sensing devices and other networked control modules, and execute control and diagnostic routines to control operation of actuators. Loop cycles may be executed at regular intervals, for example each 3.125, 6.25, 12.5, 25 and 100 milliseconds during ongoing engine and vehicle operation. Alternatively, algorithms may be executed in response to occurrence of an event.

A control module 5 (E-H CONTROLLER) controls operation of the exemplary control circuit to control a position of the engine valve 9, which includes a magnitude of valve lift L, duration of valve opening D, preferably measured in crank angle degrees, and timing of the valve opening, preferably measured in crank angle degrees relative to top-dead-center of piston travel. It should be appreciated that phasing of the valve opening is encompassed in the timing of the valve opening and the duration of the valve opening. The position of the engine valve 9 is controlled in response to a control signal $P_D(\theta_M)$ that is output from the control module 5, in accordance with predetermined control schemes and based upon predetermined valve profiles described herein.

In one embodiment, the control circuit includes a closed, high-pressure fluid circuit associated with each engine valve actuator 10, and operatively connected to the control module 5 that is signally connected to the engine control module. Although the control module 5 is shown as a discrete element in FIG. 1, such an illustration is for ease of description and it should be appreciated that the control module 5 may take any suitable form as described herein above. The control module 5 executes algorithms during preset loop cycles in the time-domain. The engine valve actuator 10 includes a valve actuator position sensor 42 that monitors engine valve lift, and generates a signal output $L_M$ corresponding to the engine valve lift that is monitored by the control module 5. The exemplary closed, high-pressure fluid circuit includes a hydraulic pump 70 fluidly connected via a conduit 80 to a first flow control valve 82, which is fluidly connected via a conduit 84 to a high pressure fluid inlet 40 of the engine valve actuator 10. A fluid outlet 68 of the engine valve actuator 10 is fluidly connected via the conduit 86 to a second flow control valve 88, which vents to a fluid sump 90. The hydraulic pump 70 and the first and second fluid flow control valves 82 and 88 are operatively connected to the control module 5. In one embodiment, the control module 5 generates the control signal $P_D(\theta_M)$ to control the first and second fluid flow control valves 82 and 88 to control flow of the hydraulic fluid to the engine valve actuator 10 and thus control the position of the engine valve 9.

In one embodiment, the first and second fluid flow control valves 82 and 88 each includes a two-state spool fluid control valve designed for use in a high-pressure fluid control system. The first state of each of the first and second fluid control valves 82 and 88 includes an open-flow condition, and the second state includes a fluidly sealed, no-flow condition. The engine valve actuator 10 is physically mounted on the cylinder head 44 with a distal end of a plunger 30 of the engine valve actuator 10 in physical contact with an end of a stem of the engine valve 9 and operative to exert opening force thereon. The engine valve 9 is preferably configured to have a spring disposed to provide a closing force. The engine valve 9 is normally closed, and the engine valve actuator 10 must generate sufficient force through the plunger 30 to overcome the spring closing force to open the engine valve 9. Opening the engine valve 9 includes linearly displacing the valve stem and valve. In one embodiment, the engine valve 9 is configured to control the engine valve position to one of two distinct steps, e.g., a low-lift engine valve position (about 4-6 mm) preferably for low speed, low load engine operation, and a high-lift engine valve position (about 8-10 mm) preferably for high speed, high load engine operation. The engine valve 9 in the closed position defines a neutral position for the engine valve actuator 10 when assembled thereto.

The high-pressure fluid circuit described hereinabove preferably uses engine oil as hydraulic fluid. However, other types of fluid can also be used with this system. The hydraulic pump 70 is sized to provide sufficient hydraulic pressure to overcome closing force of the engine valve spring coupled with pressure force generated in the combustion chamber which acts upon the inside of the cylinder head 44 and valve 9, which can be a pressure range of 7-21 MPa at high engine speed conditions in one embodiment.

Figure 2:
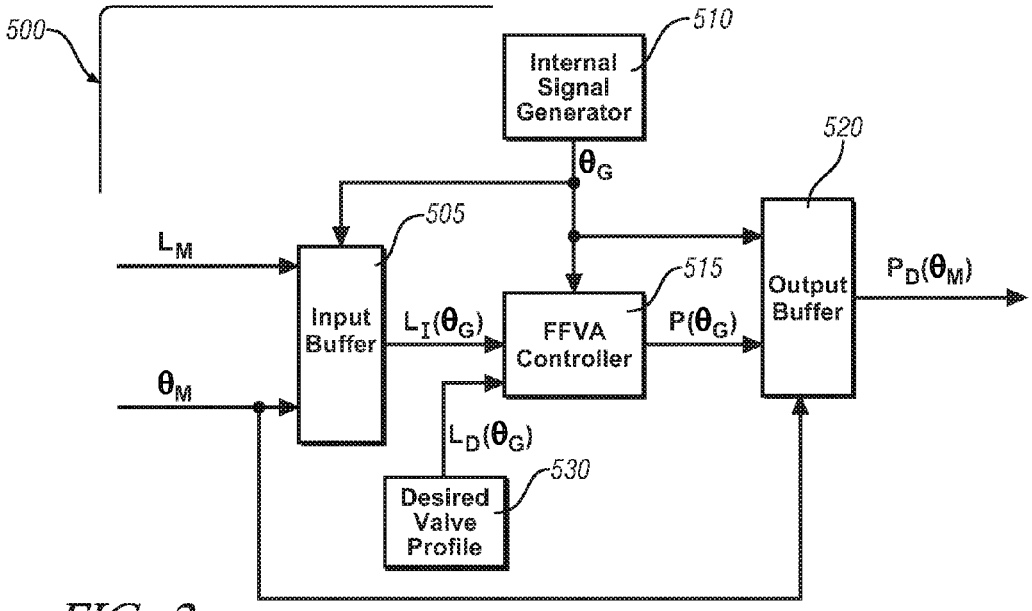
FIG. 2 is a control flow diagram embodying a control scheme for controlling the control circuit to repetitively actuate a single engine valve in accordance with the present disclosure.

FIG. 2 shows a control scheme 500 for repetitively controlling the control circuit for the engine valve 9. The control scheme 500 is illustrated and described using discrete elements for ease of description. It should be recognized that the functions performed by these elements may be combined in one or more devices, e.g., implemented in software, hardware, and/or application-specific integrated circuitry. The control scheme 500 repetitively executes to control the engine valve 9 in response to a desired valve lift profile as a function of crank angle during each engine cycle by synchronizing the engine valve position $L_M$ measured in the time-domain and the engine crank angle $\theta_M$ measured in crank angle-domain. The term "crank angle-domain" as used herein refers to operation and control that is measured in and corresponds to rotational position of the engine crank measured in crank angle degrees, e.g., using the crank sensor. The term "time-domain" as used herein refers to operation and control that is measured in and corresponds to elapsed time.

The control scheme 500 monitors the engine crank angle $\theta_M$ and the engine valve lift $L_M$ at periodic time intervals in the time-domain for input to an input buffer module 505. An internal signal generator module 510 generates an emulated engine crank angle $\theta_G$ in the time-domain. The emulated engine crank angle $\theta_G$ is used by the input buffer module 505, a repetitive fully flexible valve actuation controller (FFVA Controller) 515, and an output buffer module 520. The input buffer module 505 determines an interpolated engine valve lift $L_I(\theta_G)$ at the emulated engine crank angle $\theta_G$. A desired valve lift $L_D(\theta_G)$ can be determined based upon the desired valve lift profile 530 and the emulated engine crank angle $\theta_G$. The FFVA Controller 515 determines a control position $P(\theta_G)$ for the engine valve 9 in the crank angle-domain, indicated at the emulated engine crank angle $\theta_G$. The output buffer module 520 determines a desired control position $P_D(\theta_M)$ for the engine valve 9 in the time-domain, which can be used to control the first and second fluid flow control valves 82 and 88 in the time-domain at the monitored engine crank angle $\theta_M$ to achieve the desired valve lift $L_D(\theta_G)$.

Monitoring engine crank angle $\theta_M$ and engine valve lift $L_M$ in the time-domain includes monitoring signal inputs from the crank sensor 22 and the valve actuator position sensor 42. The internal signal generator module 510 emulates the engine crank angle by generating an emulated crank angle signal $\theta_G$ based upon an assumed fixed engine speed which can be obtained, for example, through filtering and averaging of the monitored engine speed and an operator torque request.

Inputs to the input buffer module 505 include the monitored engine valve lift $L_M$ from the valve actuator position sensor 42, the monitored engine crank angle $\theta_M$ from the crank sensor 22, and the emulated engine crank angle $\theta_G$ from the internal signal generator module 510. The monitored engine valve lift $L_M$ and the monitored engine crank angle $\theta_M$ are preferably monitored periodically at predetermined fixed time intervals, i.e., in the time-domain. The input buffer module 505 interpolates the monitored engine valve lift $L_M$ between successively monitored engine crank angles $\theta_M$ and associated with the emulated engine crank angle $\theta_G$ to determine the interpolated engine valve lift $L_I(\theta_G)$ in the crank angle-domain, which is communicated to the FFVA controller 515.

The signal generator module 510 generates the emulated engine crank angle $\theta_G$ to output to the input buffer module 505, the output buffer module 520, and the FFVA controller 515. The emulated engine crank angle $\theta_G$ is in the time-domain and determined based upon an assumed fixed engine speed which can be obtained, for example, through filtering of the monitored engine speed. The signal generator module 510 outputs the emulated engine crank angle $\theta_G$ at a fixed rate with respect to time until the operator torque request indicates a different engine speed. The emulated engine crank angle $\theta_G$ defines the crank angle-domain for the FFVA controller 515 and the output buffer module 520.

Preferably each engine cycle, the control module 5 determines the speed/load operating point and determines a speed/load operating zone corresponding to the speed/load operating point. The preferred or desired engine valve lift profile 530 associated with the speed/load operating zone is selected by the control scheme 500. Each speed/load operating zone has a corresponding predetermined engine valve lift profile 530. Each predetermined engine valve lift profile is an array of valve lift states each corresponding to a crank angle state, preferably expressed as crank angle (deg.) and corresponding magnitude of lift (mm). The array of valve lift states associated with the predetermined engine valve lift profile 530 is expressed as $L_D(\theta_G)$. It should be appreciated that predetermined engine valve lift profiles can be determined by one skilled in the art based upon the selected internal combustion engine system, the selected combustion mode, and the selected air/fuel ratio regime. The predetermined engine valve profile 530 is input into the FFVA controller 515.

The FFVA controller 515 selects a control position $P(\theta_G)$ for the engine valve 9 in the crank angle-domain based on the emulated crank angle $\theta_G$, the interpolated engine valve lift $L_I(\theta_G)$, and the predetermined valve lift profile $L_D(\theta_G)$ using repetitive control methods. One skilled in the art can use the predetermined valve lift profile $L_D(\theta_G)$ to determine the control position $P(\theta_G)$ for the engine valve 9 in the crank angle-domain based on the emulated crank angle $\theta_G$ and the interpolated engine valve lift $L_I(\theta_G)$. The FFVA Controller 515 determines a control position $P(\theta_G)$ for the engine valve 9 in the crank angle-domain, indicated at the emulated engine crank angle $\theta_G$. The output buffer module 520 determines a desired control position $P_D(\theta_M)$ for the engine valve 9 in the time-domain to achieve the The monitored engine crank angle $\theta_M$ from the crank sensor 22, the control position $P(\theta_G)$, and the emulated engine crank angle $\theta_G$ are input to the output buffer module 520. The output buffer module 520 interpolates the control position $P(\theta_G)$ between the monitored engine crank angle $\theta_M$ and the emulated engine crank angle $\theta_G$ to determine a desired control position $P_D(\theta_M)$ for the engine valve 9. The desired control position $P_D(\theta_M)$ is communicated to the first and second fluid flow control valves 82 and 88 in the time-domain to control lift of the engine valve 9.

In operation, the control module 5 synchronizes a desired time-domain controlled engine valve position with the engine crank angle $\theta_M$ based upon the monitored engine crank angle $\theta_M$, the engine valve position $L_M$, and the emulated engine crank angle $\theta_G$, and repetitively controls the engine valve actuator 10 in the time-domain synchronized to the monitored engine crank angle $\theta_M$.

FIGS. 3-8 depict elements related to execution of the control scheme 500 to repetitively control position of the engine valve 9 using time-domain-based control.

Figure 3A:
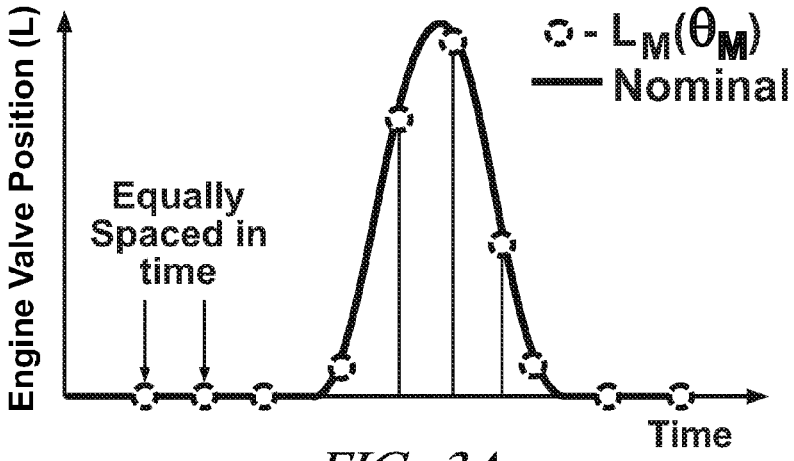
FIGS. 3-5 graphically illustrate a monitored engine valve lift $L_M$ in the time-domain, a monitored engine crank angle $\theta_M$ and nominal emulated engine crank angle $\theta_G$ in the time-domain, and monitored engine valve lift $L_M(\theta_M)$ and an interpolated engine valve lift $L_I(\theta_G)$ in the crank angle-domain in accordance with the present disclosure.
Figure 3B:
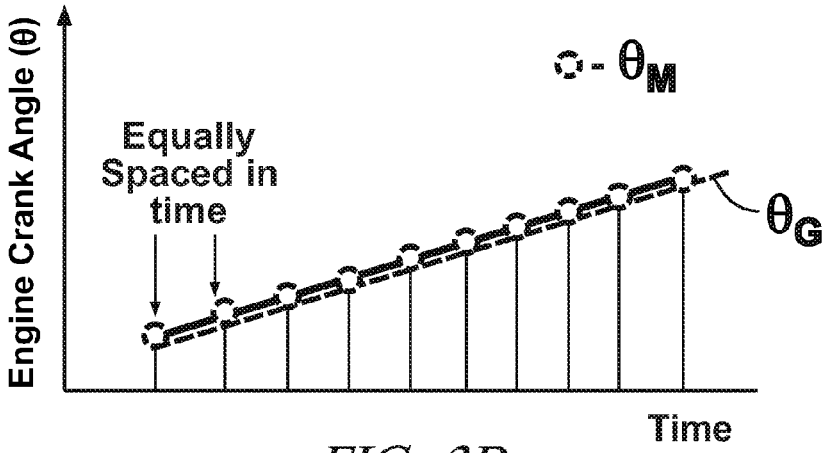
Figure 3C:
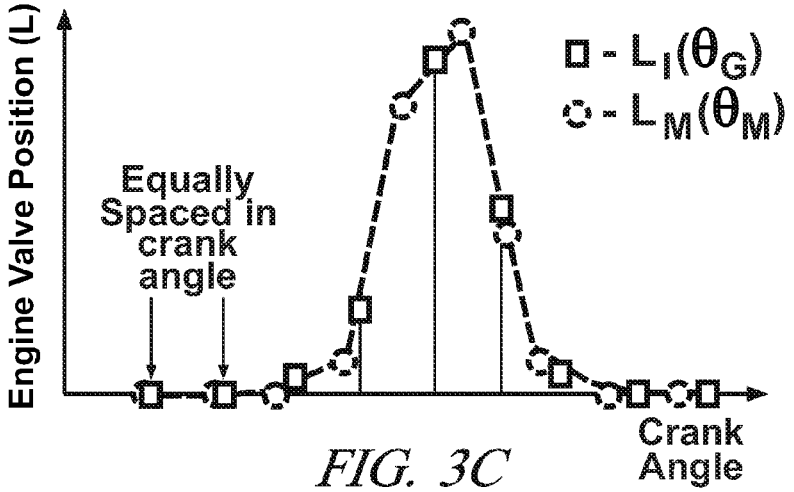

FIGS. 3A-3C show signals for valve operation with the engine operating at a predetermined desired rotational speed (nominal), with the emulated engine crank angle $\theta_G$ corresponding to the monitored engine crank angle $\theta_M$ in the time-domain. FIG. 3A graphically illustrates monitored engine valve lift $L_M(\theta_M)$ that is the nominal engine valve lift in the time-domain. FIG. 3B graphically illustrates monitored engine crank angle $\theta_M$ and the nominal emulated engine crank angle $\theta_G$ in the time-domain. FIG. 3C graphically illustrates the monitored engine valve lift $L_M(\theta_M)$ and an interpolated engine valve lift $L_I(\theta_G)$ in the crank angle-domain. As indicated, the interpolated engine valve lift at the emulated engine crank angle $L_I(\theta_G)$ tracks the monitored engine valve lift at the monitored engine crank angle $L_M(\theta_M)$ in the crank angle-domain when the engine is operating at the predetermined desired rotational speed (nominal).

Figure 4A:
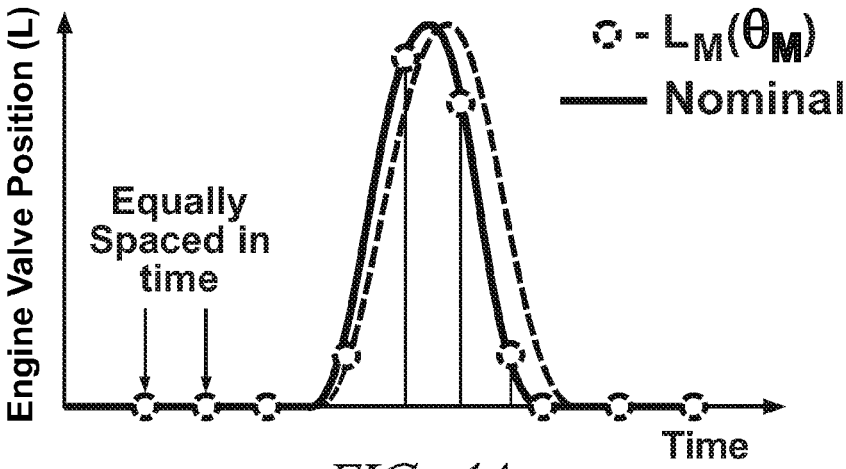
Figure 4B:
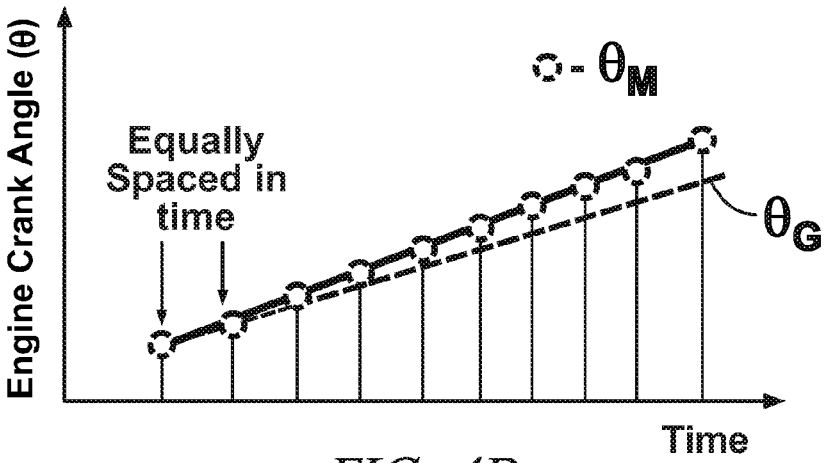
Figure 4C:
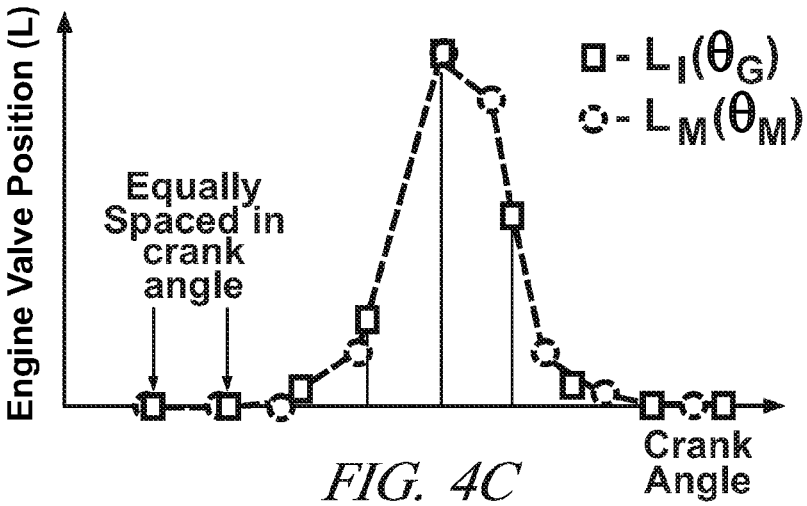

FIGS. 4A-4C show signals for valve operation with the engine operating slower than the predetermined desired rotational speed (nominal), with the emulated engine crank angle $\theta_G$ slower than the monitored engine crank angle $\theta_M$ in the time-domain. FIG. 4A graphically illustrates monitored engine valve lift $L_M(\theta_M)$ that is slower than the nominal engine valve lift in the time-domain. FIG. 4B graphically illustrates monitored engine crank angle $\theta_M$ and the nominal emulated engine crank angle $\theta_G$ in the time-domain. FIG. 4C graphically illustrates the monitored engine valve lift $L_M(\theta_M)$ and an interpolated engine valve lift $L_I(\theta_G)$ in the crank angle-domain. As indicated, the interpolated engine valve lift at the emulated engine crank angle $L_I(\theta_G)$ tracks the monitored engine valve lift at the monitored engine crank angle $L_M(\theta_M)$ in the crank angle-domain when the engine is operating slower than the predetermined desired rotational speed (nominal).

Figure 5A:
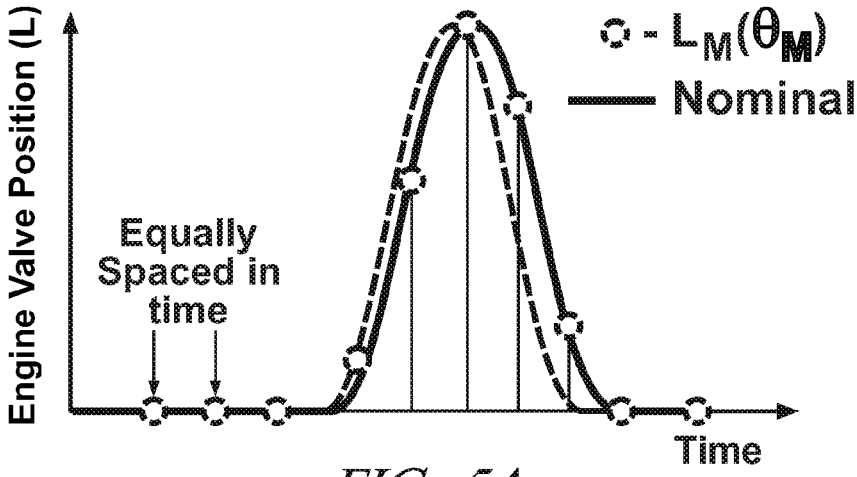
Figure 5B:
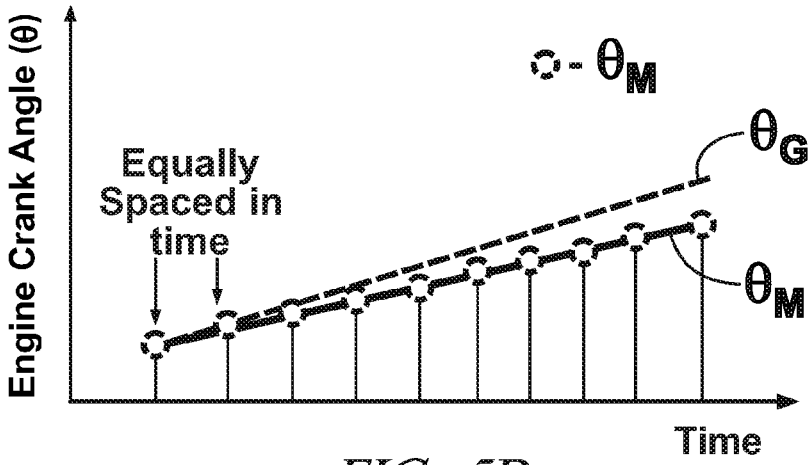
Figure 5C:
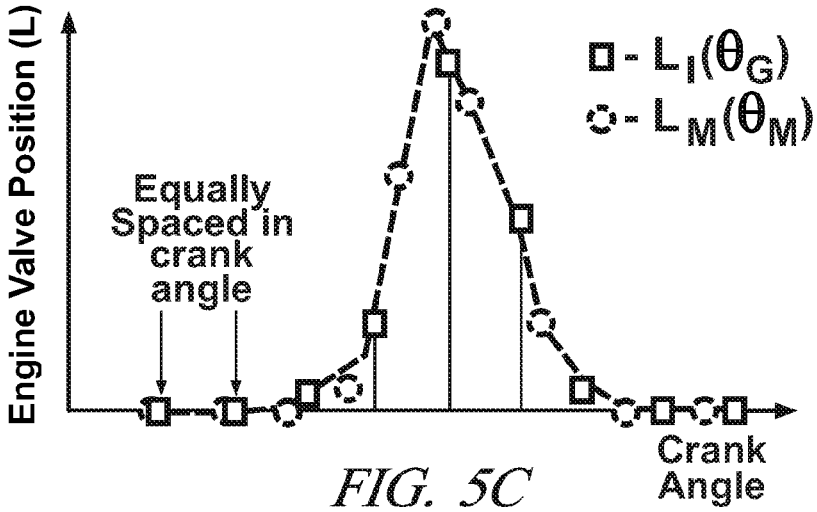

FIGS. 5A-5C show signals for valve operation with the engine operating slower than the predetermined desired rotational speed (nominal), with the emulated engine crank angle $\theta_G$ faster than the monitored engine crank angle $\theta_M$ in the time-domain. FIG. 5A graphically illustrates monitored engine valve lift $L_M(\theta_M)$ that is faster than the nominal engine valve lift in the time-domain. FIG. 5B graphically illustrates monitored engine crank angle $\theta_M$ and the nominal emulated engine crank angle $\theta_G$ in the time-domain. FIG. 5C graphically illustrates the monitored engine valve lift $L_M(\theta_M)$ and an interpolated engine valve lift $L_I(\theta_G)$ in the crank angle-domain. As indicated, the interpolated engine valve lift at the emulated engine crank angle $L_I(\theta_G)$ tracks the monitored engine valve lift at the monitored engine crank angle $L_M(\theta_M)$ in the crank angle-domain when the engine is operating faster than the predetermined desired rotational speed (nominal).

In any event, the interpolated engine valve lift at the emulated engine crank angle $L_I(\theta_G)$ is input to the FFVA Controller 515 to determine the control position $P(\theta_G)$ for the engine valve 9 at the emulated engine crank angle $\theta_G$ in conjunction with the desired valve profile $L_D(\theta_G)$ based on the emulated crank angle $\theta_G$, the interpolated engine valve lift $L_I(\theta_G)$, and a predetermined valve profile using repetitive control methods.

FIGS. 6-8 depict operation of the output buffer module 520 to convert the control position $P(\theta_G)$ for the engine valve 9 in crank angle-domain to the control position $P_D(\theta_M)$ for the engine valve 9 in the time-domain using interpolation based upon the emulated engine crank angle $\theta_G$ and the measured engine crank angle $\theta_M$.

Figure 6A:
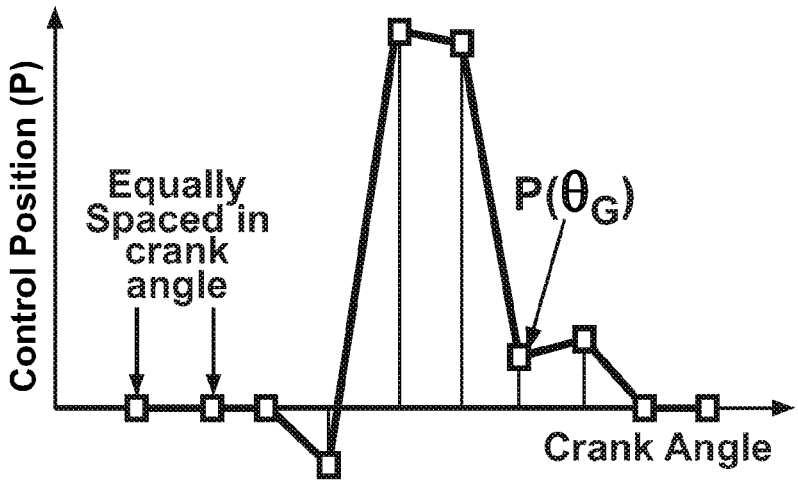
FIGS. 6-8 graphically illustrate valve control position P plotted as a function of the emulated engine crank angle $\theta_G$, a monitored engine crank angle $\theta_M$ and nominal emulated engine crank angle $\theta_G$ in the time-domain, and a control position $P(\theta_G)$ and a corresponding interpolated control position $P_M(\theta_G)$ in the time-domain in accordance with the present disclosure.
Figure 6B:
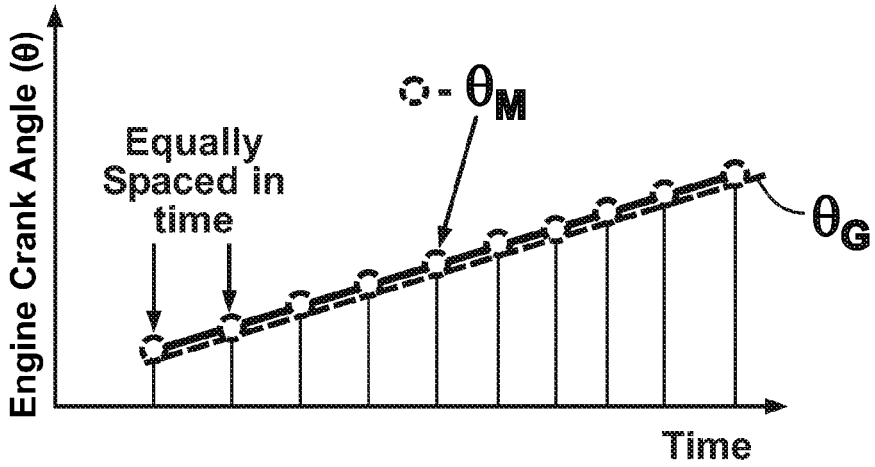
Figure 6C:
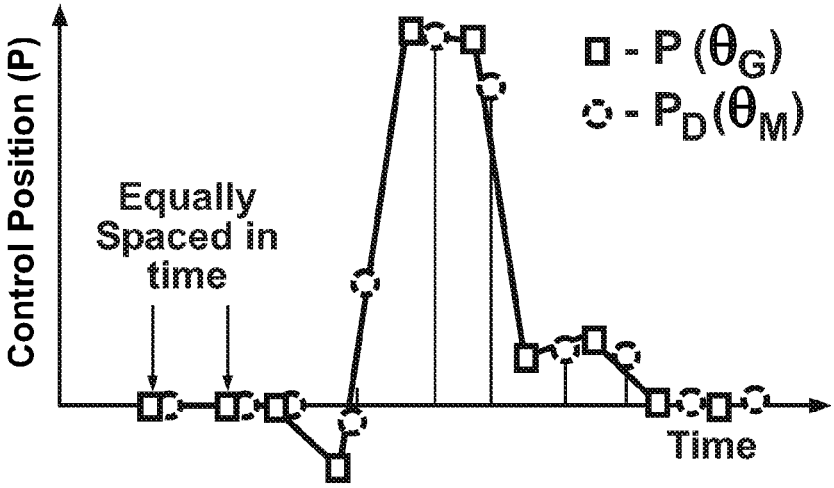

FIGS. 6A-6C depict signals for valve operation with the engine operating at the predetermined desired rotational speed (nominal), with the emulated engine crank angle $\theta_G$ at the same rate as the monitored engine crank angle $\theta_M$ in the time-domain. FIG. 6A graphically illustrates the control position P plotted as a function of the emulated engine crank angle $\theta_G$. FIG. 6B graphically illustrates monitored engine crank angle $\theta_M$ and the nominal emulated engine crank angle $\theta_G$ in the time-domain. FIG. 6C graphically illustrates the control position $P(\theta_G)$ output from the FFVA controller 515 and the corresponding interpolated control position $P_D(\theta_M)$ output from the output buffer 520. As indicated, the interpolated control position $P_D(\theta_M)$ output from the output buffer 520 tracks the control position $P(\theta_G)$ output from the FFVA controller 515 in the crank angle-domain when the engine is operating at the predetermined desired rotational speed.

Figure 7A:
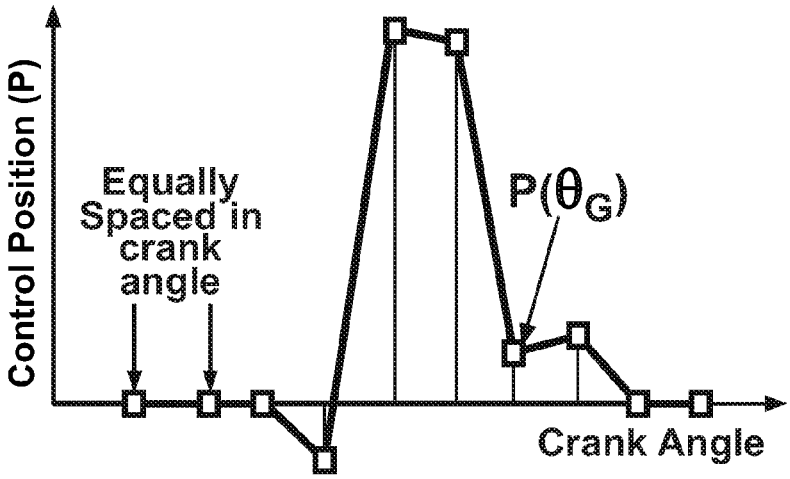
Figure 7B:
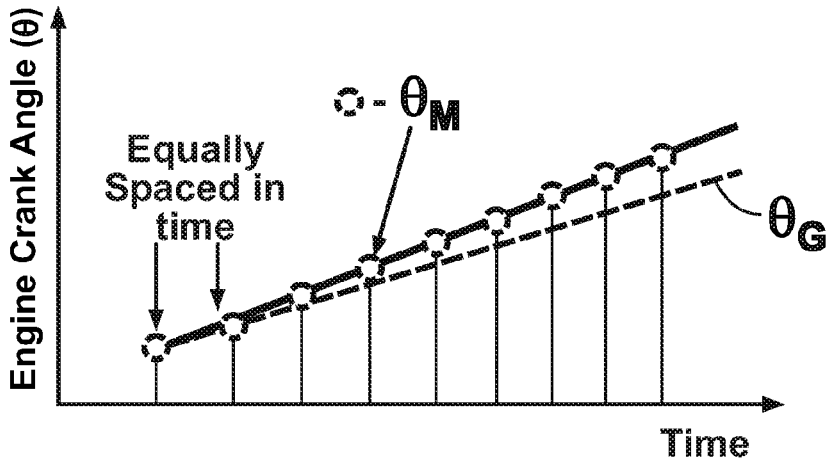
Figure 7C:
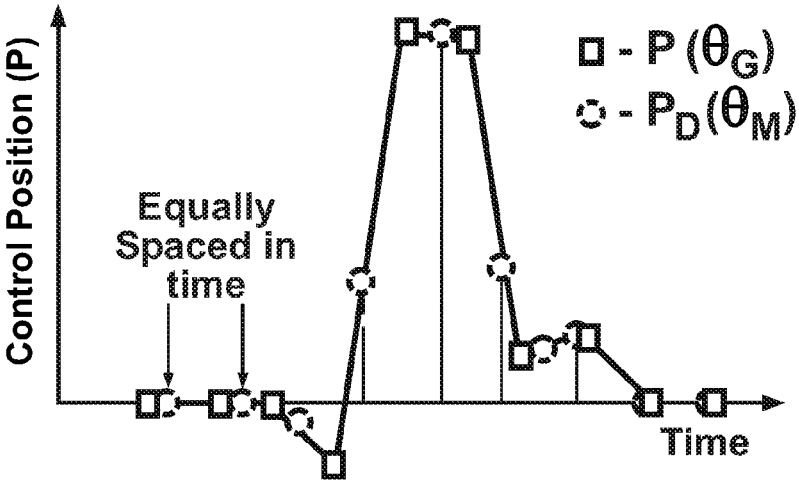

FIGS. 7A-7C depict signals for valve operation with the engine operating slower than the predetermined desired rotational speed (nominal), with the emulated engine crank angle $\theta_G$ slower than the monitored engine crank angle $\theta_M$ in the time-domain. FIG. 7A graphically illustrates the control position P plotted as a function of the emulated engine crank angle $\theta_G$. FIG. 7B graphically illustrates monitored engine crank angle $\theta_M$ and the nominal emulated engine crank angle $\theta_G$ in the time-domain. FIG. 7C graphically illustrates the control position $P(\theta_G)$ output from the FFVA controller 515 and the corresponding control position $P_D(\theta_M)$ output from the output buffer 520. As indicated, the interpolated control position $P_D(\theta_M)$ output from the output buffer 520 tracks the control position $P(\theta_G)$ output from the FFVA controller 515 in the crank angle-domain when the engine is operating slower than the predetermined desired rotational speed.

Figure 8A:
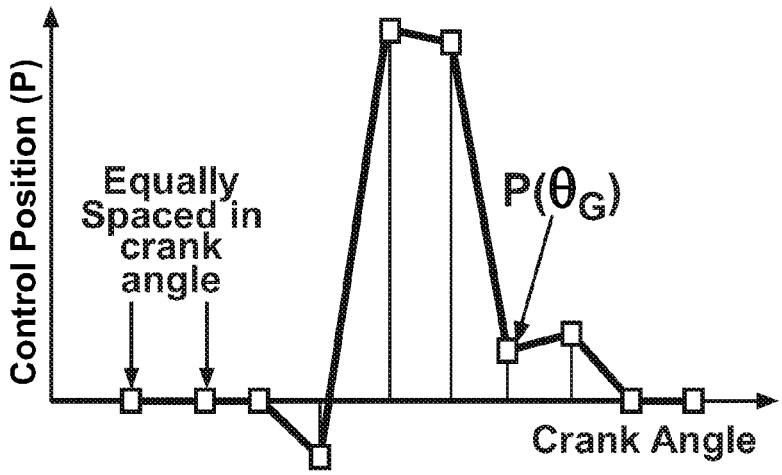
Figure 8B:
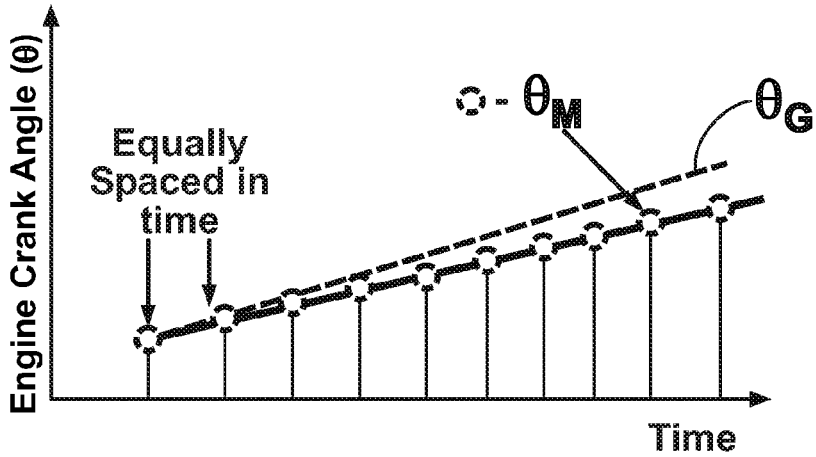
Figure 8C:
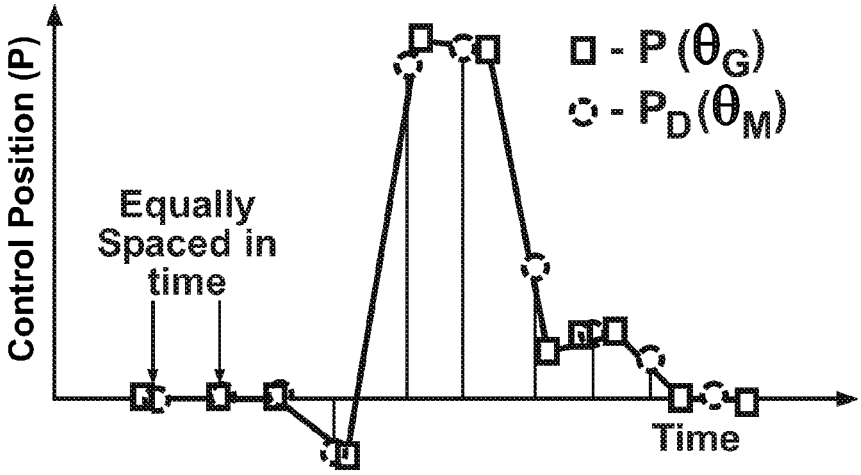

FIGS. 8A-8C depict signals for valve operation with the engine operating slower than the predetermined desired rotational speed (nominal), with the emulated engine crank angle $\theta_G$ faster than the monitored engine crank angle $\theta_M$ in the time-domain. FIG. 8A graphically illustrates the control position P plotted as a function of the emulated engine crank angle $\theta_G$. FIG. 8B graphically illustrates monitored engine crank angle $\theta_M$ and the nominal emulated engine crank angle $\theta_G$ in the time-domain. FIG. 8C graphically illustrates the control position $P(\theta_G)$ output from the FFVA controller 515 and the corresponding control position $P_D(\theta_M)$ output from the output buffer 520. As indicated, the interpolated control position $P_D(\theta_M)$ output from the output buffer 520 tracks the control position $P(\theta_G)$ output from the FFVA controller 515 in the crank angle-domain when the engine is operating faster than the predetermined desired rotational speed.

In one embodiment, the control module 5 commands the first and second fluid flow control valves 82 and 88 to control flow of the hydraulic fluid to the engine valve actuator 10 to achieve the desired control position $P_D(\theta_M)$.

Figure 9:
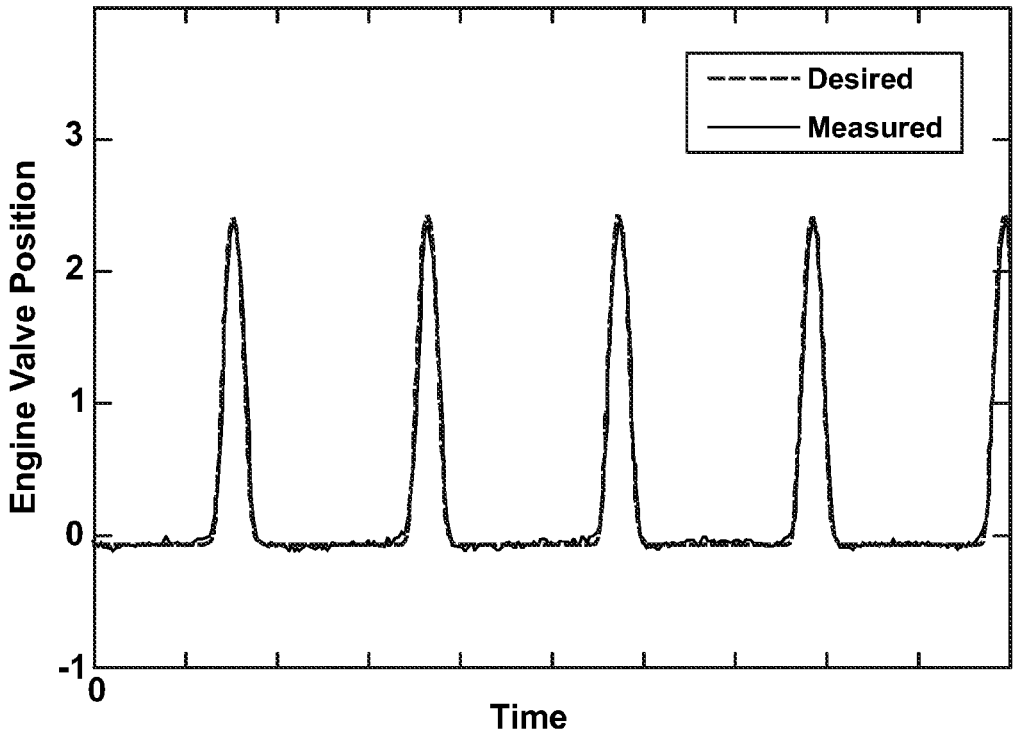
FIG. 9 graphically shows data depicting engine valve lift in accordance with the present disclosure.

FIG. 9 shows a data graph depicting results for the exemplary implementation of the control scheme 500. The data graph shows desired and measured engine valve position over repetitive engine cycles and at a constant engine speed. As FIG. 9 shows, the desired valve lift, i.e., desired valve profile $L_D(\theta_G)$ corresponds to the measured engine valve lift, i.e., engine valve position $L_M$ at engine crank angle $\theta_M$.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method for controlling an engine valve of an internal combustion engine, comprising:

periodically monitoring an engine valve lift and a corresponding engine crank angle;

determining a preferred engine valve lift profile in a crank angle-domain;

determining a preferred engine valve position in the crank angle-domain associated with the preferred engine valve lift profile, the monitored engine valve lift, and the engine crank angle;

interpolating the preferred engine valve position in the crank angle-domain to determine a preferred engine valve position in the time-domain; and actuating a control circuit configured to control a position of the engine valve to the preferred engine valve position in the time-domain.

2. The method of claim 1, wherein periodically monitoring the engine valve lift and the corresponding engine crank angle comprises:

periodically monitoring the engine valve lift and the corresponding engine crank angle in the time-domain; and generating an emulated engine crank angle based upon the periodically monitored engine crank angle in the time-domain.

3. The method of claim 2, wherein determining the preferred engine valve position in the crank angle-domain associated with the preferred engine valve lift profile, the monitored engine valve lift, and the engine crank angle comprises:

interpolating the monitored engine valve lift and the corresponding engine crank angle in the time-domain to determine an interpolated engine valve lift at the emulated engine crank angle; and determining the preferred engine valve position in the crank angle-domain associated with the preferred engine valve lift profile and the interpolated engine valve lift at the emulated engine crank angle.

4. The method of claim 3, wherein interpolating the preferred engine valve position in the crank angle-domain to determine the preferred engine valve position in the time-domain comprises interpolating the preferred engine valve position in the crank angle-domain using the monitored engine crank angle and the emulated engine crank angle to determine the preferred engine valve position in the time-domain.

5. The method of claim 4, wherein actuating the control circuit configured to control the position of the engine valve to the preferred engine valve position in the time-domain comprises actuating the control circuit to control magnitude of engine valve lift, duration of engine valve opening, and timing of engine valve opening in the time-domain.

6. The method of claim 4, wherein the engine valve comprises an intake valve.

7. The method of claim 4, wherein the engine valve comprises an exhaust valve.

8. Method for controlling position of an engine valve of an internal combustion engine, comprising:

periodically monitoring engine valve lift and a corresponding engine crank angle in a time-domain;

generating an emulated engine crank angle based upon the periodically monitored engine crank angle;

interpolating the monitored engine valve lift and the corresponding engine crank angle to determine an interpolated engine valve lift at the emulated engine crank angle;

determining a preferred engine valve lift profile in a crank angle-domain;

determining a preferred engine valve position in the crank angle-domain associated with the preferred engine valve lift profile and the interpolated engine valve lift at the emulated engine crank angle;

interpolating the preferred engine valve position in the crank angle-domain to determine a preferred engine valve position in the time-domain; and actuating a control circuit to control the engine valve to the preferred engine valve position in the time-domain.

9. The method of claim 8, wherein interpolating the preferred engine valve position in the crank angle-domain to determine the preferred engine valve position in the time-domain comprises interpolating the preferred engine valve position in the crank angle-domain using the monitored engine crank angle and the emulated engine crank angle to determine the preferred engine valve position in the time-domain.

10. The method of claim 9, wherein actuating the control circuit to control the engine valve to the preferred engine valve position in the time-domain comprises actuating the control circuit to control magnitude of engine valve lift, duration of engine valve opening, and timing of engine valve opening in the time-domain.

11. Method for controlling a control circuit configured to control lift of an engine valve of an internal combustion engine, comprising:

periodically monitoring engine valve lift and a corresponding engine crank angle;

generating an emulated engine crank angle based upon the periodically monitored engine crank angle;

interpolating the monitored engine valve lift and the corresponding engine crank angle to determine an interpolated engine valve lift at the emulated engine crank angle;

determining a preferred engine valve lift profile in a crank angle-domain;

determining a preferred engine valve position in the crank angle-domain associated with the preferred engine valve lift profile and the interpolated engine valve lift at the emulated engine crank angle;

interpolating the preferred engine valve position in the crank angle-domain to determine a preferred engine valve position; and actuating the control circuit to control lift of the engine valve corresponding to the preferred engine valve position.

12. The method of claim 11, wherein actuating the control circuit to control lift of the engine valve corresponding to the preferred engine valve position comprises actuating the control circuit to control lift of the engine valve corresponding to the preferred engine valve position in a time-domain.

* * * * *